US006978554B2

(12) United States Patent
Stinnett et al.

(10) Patent No.: US 6,978,554 B2
(45) Date of Patent: Dec. 27, 2005

(54) APPARATUS AND METHODS FOR CONTROLLING OPERATION OF WASHING MACHINES

(75) Inventors: Laura Suggs Stinnett, Louisville, KY (US); Lucas Ray Mallory, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/722,297

(22) Filed: Nov. 25, 2003

(65) Prior Publication Data

US 2005/0108891 A1 May 26, 2005

(51) Int. Cl.[7] ..... F16B 19/00; D06F 33/00
(52) U.S. Cl. ..... 34/527; 68/12.12
(58) Field of Search ..... 68/12.25, 12.01, 68/12.12; 34/312, 447, 58, 524, 527

(56) References Cited

U.S. PATENT DOCUMENTS

| | | | | |
|---|---|---|---|---|
| 3,957,661 | A | 5/1976 | Vérité | |
| 4,018,067 | A | 4/1977 | Vona, Jr. et al. | |
| 4,410,329 | A | 10/1983 | Blevins et al. | |
| 4,411,664 | A * | 10/1983 | Rickard et al. | 8/158 |
| 4,949,557 | A | 8/1990 | Price | |
| 4,986,093 | A | 1/1991 | Pastryk et al. | |
| 4,987,627 | A | 1/1991 | Cur et al. | |
| 5,031,427 | A | 7/1991 | Pastryk et al. | |
| 5,167,722 | A | 12/1992 | Pastryk et al. | |
| 5,191,667 | A | 3/1993 | Roy et al. | |
| 5,191,668 | A | 3/1993 | Euler et al. | |
| 5,191,669 | A | 3/1993 | Euler et al. | |
| 5,199,127 | A | 4/1993 | Van Newenhizen et al. | |
| 5,219,370 | A | 6/1993 | Farrington et al. | |
| 5,233,718 | A | 8/1993 | Hardaway et al. | |
| 5,249,441 | A | 10/1993 | Pastryk et al. | |
| 5,257,901 | A | 11/1993 | Malchow | |
| 5,271,251 | A | 12/1993 | Kovich et al. | |
| 5,335,524 | A * | 8/1994 | Sakane | 68/12.04 |
| 5,361,439 | A | 11/1994 | Malchow | |
| 5,596,889 | A * | 1/1997 | Guerra et al. | 68/12.02 |
| 5,890,247 | A | 4/1999 | Erickson et al. | |
| 6,269,666 | B1 | 8/2001 | Whah et al. | |
| 6,393,872 | B2 | 5/2002 | Whah et al. | |
| 6,445,101 | B2 | 9/2002 | Ley | |
| 6,584,811 | B2 | 7/2003 | Whah et al. | |
| 6,591,439 | B2 | 7/2003 | Whah et al. | |

* cited by examiner

*Primary Examiner*—Kenneth Rinehart
(74) *Attorney, Agent, or Firm*—George L. Rideout; Armstrong Teasdale LLP

(57) ABSTRACT

A method for extracting water from laundry articles between a wash cycle and a rinse cycle is provided. The method including performing a spin cycle between the wash cycle and the rinse cycle, the spin cycle including a first initial spin, a first rest period after the first initial spin and a spin subsequent the first rest period lasting until an end of the spin cycle.

20 Claims, 4 Drawing Sheets

APPARATUS AND METHODS FOR CONTROLLING OPERATION OF WASHING MACHINES

BACKGROUND OF THE INVENTION

This invention relates generally to washing machines and, more particularly, to methods and apparatus for controlling operation of washing machines.

Washing machines typically include a cabinet that houses a stationary outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain to execute a wash cycle.

Traditionally, rinse portions of wash cycles include a deep-fill process wherein articles in the clothes basket are completely submerged in water and the water is agitated. As such, a large amount of water mixes with detergent to produce suds for cleaning the clothes in the clothes basket. Excess suds can be generated under certain combinations of detergent amount, softness of water, material of laundry articles, and water temperature. The production of excess suds can cause a problem commonly called "suds lock". Suds lock occurs when suds build up beyond the bottom of the basket and climb between the sides of the basket and tub. The suds between the spinning basket and the fixed tub produces a significant drag force on the basket.

BRIEF DESCRIPTION OF THE INVENTION

In one aspect, a method for extracting water from laundry articles between a wash cycle and a rinse cycle is provided. The method including performing a spin cycle between the wash cycle and the rinse cycle, the spin cycle including a first initial spin, a first rest period after the first initial spin and a spin subsequent the first rest period lasting until an end of the spin cycle.

In another aspect, a washing machine is provided. The washing machine includes a tub, a motor providing motion for the tub, and a controller operatively coupled to the motor for controlling the motor, the controller is configured to perform a spin cycle between a wash cycle and a rinse cycle by starting the motor for a first initial spin, stopping the motor for a first rest period, and starting the motor subsequent the first rest period to spin until the spin cycle ends.

In a further aspect, a control system for a washing machine is provided. The washing machine includes a tub and a motor coupled to the tub to provide agitation in the tub, the control system configured to perform a spin cycle between a wash cycle and a rinse cycle by starting the motor for a first initial spin, stopping the motor for a first rest period, and starting the motor subsequent the first rest period to spin until the spin cycle ends.

DETAILED DESCRIPTION OF THE INVENTION

Figure 1:
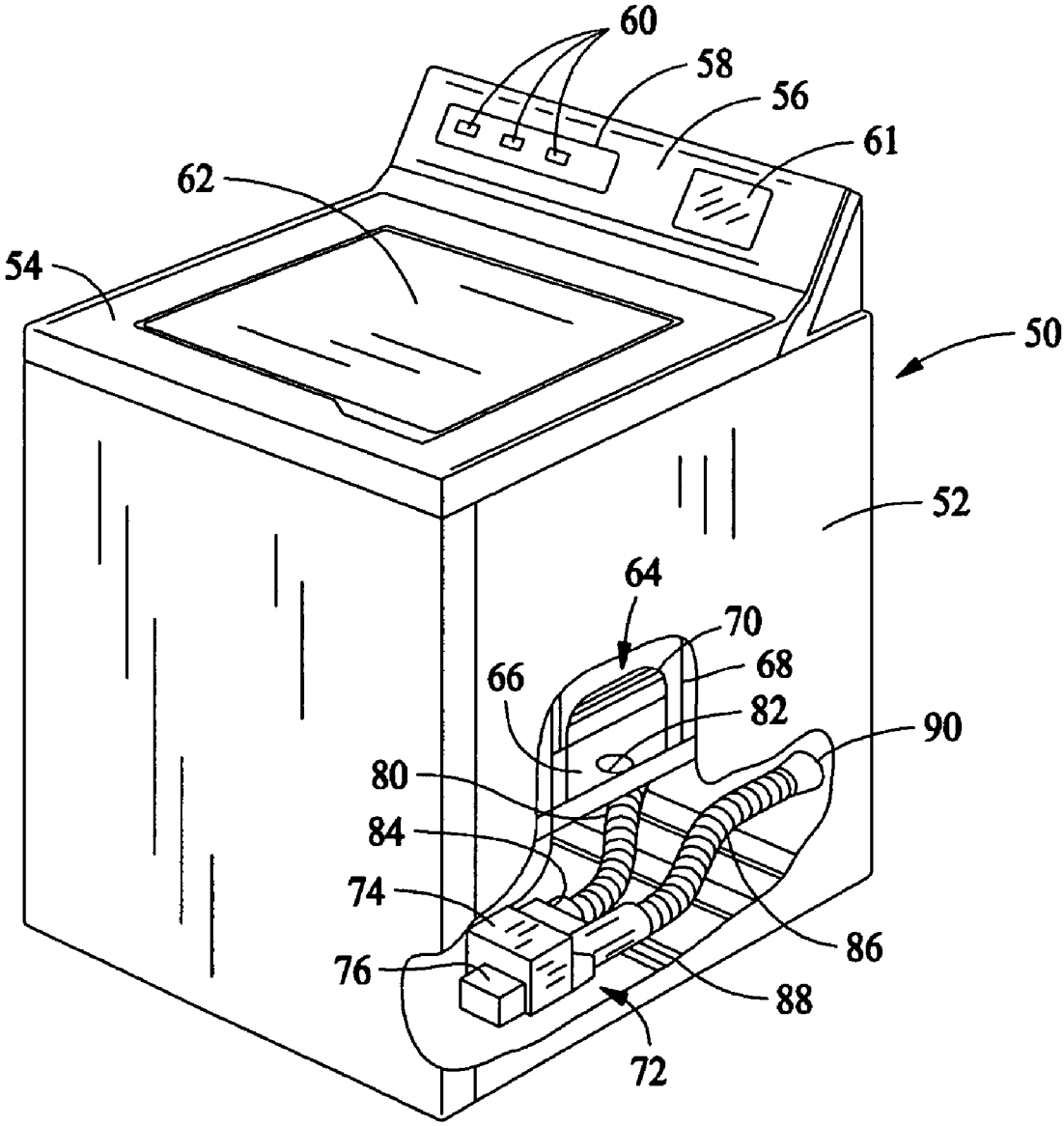
FIG. 1 is a perspective view partially broken away of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and, in one embodiment, a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine, however, it is contemplated that the benefit of the invention accrue to other types of washing machines indicating horizontal axis machines, and, therefore, as used herein, the term washing machine refers to both vertical axis and horizontal axis machines and the term tub refer to both a tub for a vertical axis machine and a tub for a horizontal axis machine.

Tub 64 includes a bottom wall 66 and a sidewall 68. A basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
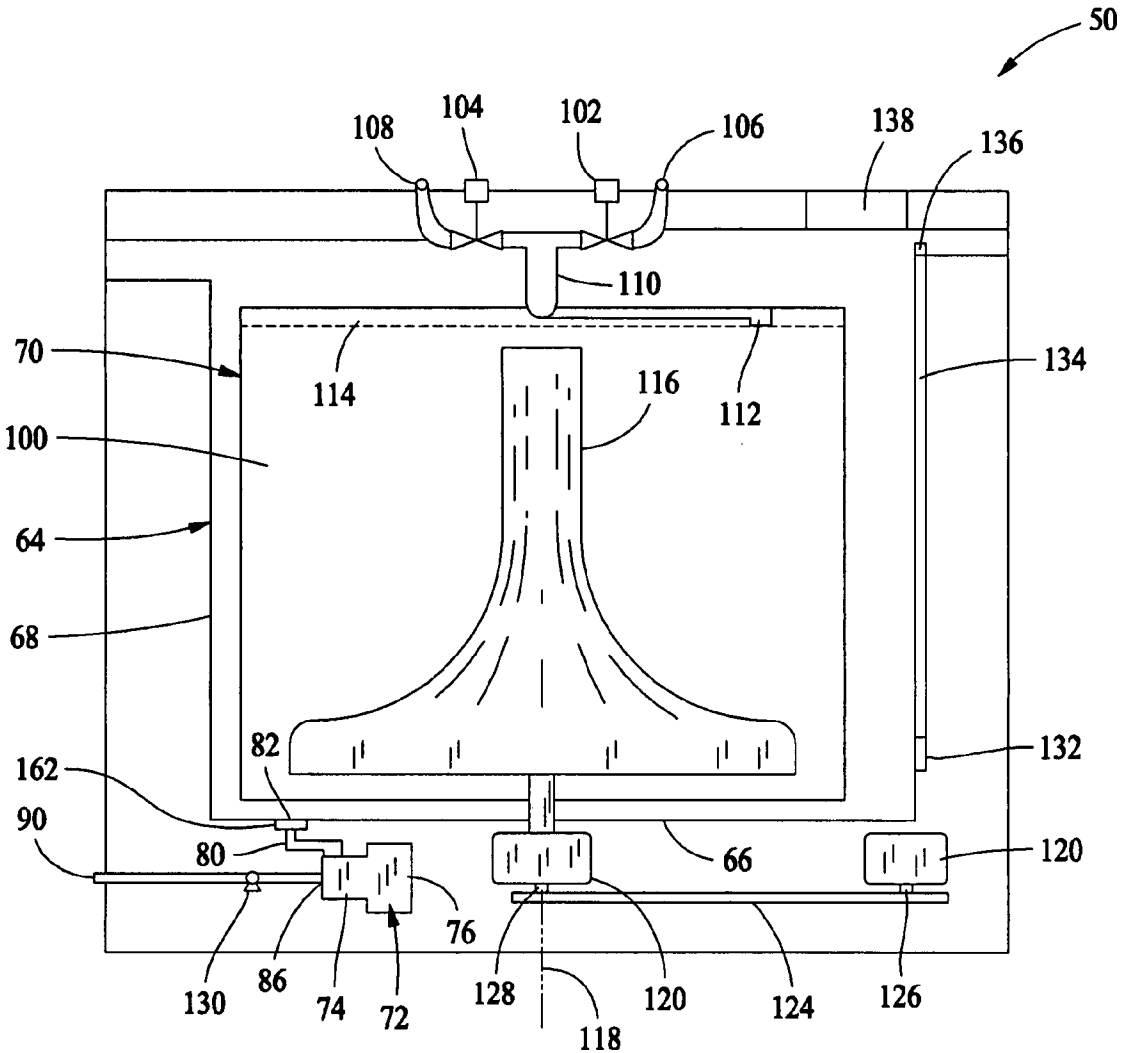
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70.

The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122, and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used. In an exemplary embodiment, machine 50 also includes a reservoir 132, a tube 134, and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element 116 is moved back and forth in an oscillatory back and forth motion. In the illustrated embodiment, agitation element 116 is rotated clockwise a specified amount about the vertical axis 118 of the machine 50, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
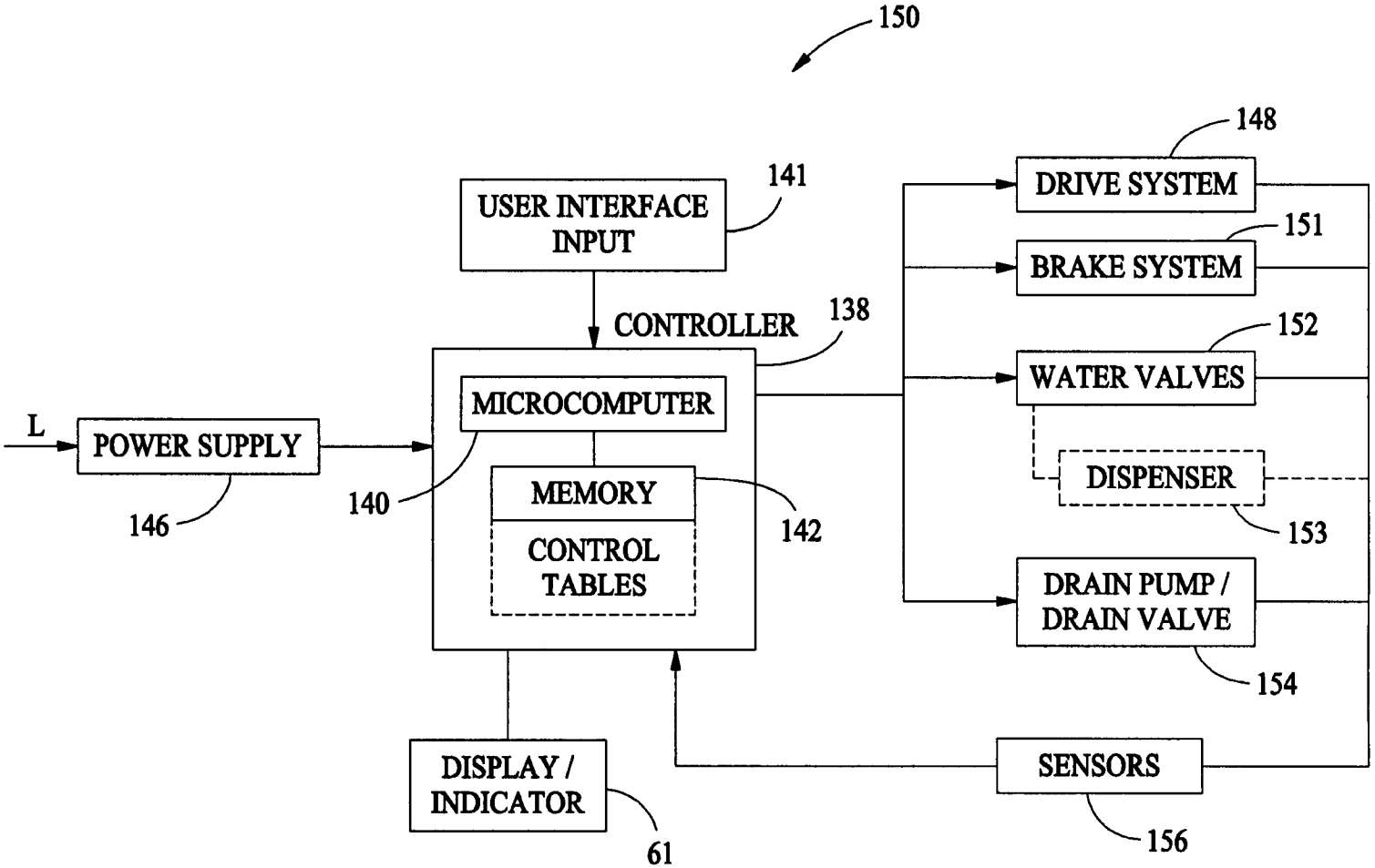
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Microcomputer 140 is programmed to perform functions described herein, and as used herein, the term microcomputer is not limited to just those integrated circuits referred to in the art as microprocessor, but broadly refers to computers, processors, microcontrollers, microprocessor, programmable logic controllers, application specific integrated circuits, and other programmable circuits, and these terms are used interchangeably herein.

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120 and clutch system 122 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein.

Figure 4:
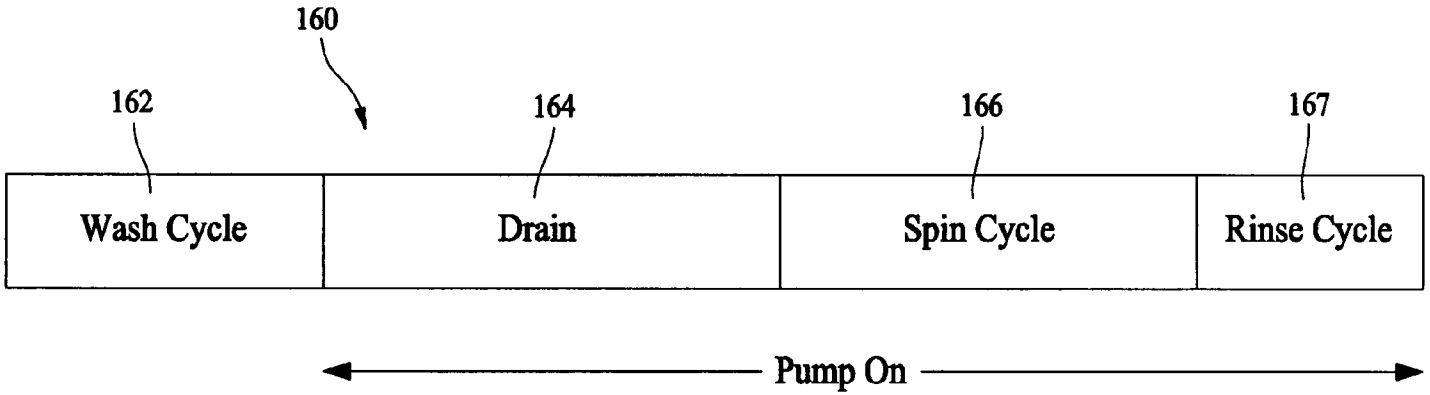
Prior Art FIG. 4
FIG. 4 illustrates a conventional washing machine cycle.

FIG. 4 illustrates a conventional washing machine cycle 160. Washing machine cycle 160 includes a wash cycle 162, a drain cycle 164, a spin cycle 166, and a rinse cycle 167. Typically, pump assembly 72 is activated during drain cycle 164 and spin cycle 166.

Figure 5:
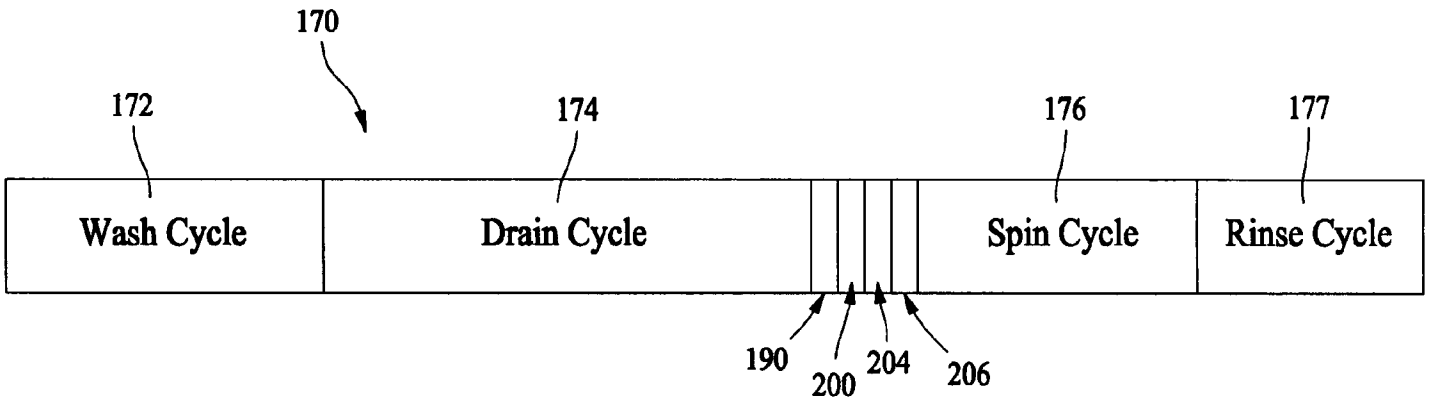
FIG. 5 illustrates an exemplary embodiment of a washing machine cycle for reducing suds lock in a washing machine.

FIG. 5 illustrates a washing machine method 170 for reducing suds lock in washing machine 50. Washing machine 50 performs method 170 cycle including a wash cycle 172, a drain cycle 174, a spin cycle 176, and a rinse cycle 177. Between wash cycle 172 and rinse cycle 177, method 170 initiates a first initial spin 190 and then stops spinning for a first rest period 200 after first initial spin 190. After first rest period 200, method 170 initiates spinning again which lasts until the end of spin cycle 176. In the exemplary embodiment, method 170 initiates a second initial spin 204 subsequent first rest period 200 and then stops spinning for a second rest period 206 after second initial spin 204. After second rest period 206, method 170 initiates spinning again which lasts until the end of spin cycle 176. In one embodiment, method utilizes a two speed motor (not shown) to initiate first and second initial spins 190 and 204, to stop washing machine for first and second rest periods 200 and 206, and the spinning that continues until the end of the spin cycle 176 at different speeds as described below in greater detail.

In one embodiment, method 170 operates first initial spin 190 for up to eight seconds. In another embodiment, method 170 operates first initial spin 190 for approximately eight seconds, such as between six and ten seconds. In a further embodiment, method 170 operates first initial spin 190 for at least eight seconds.

In one embodiment, method 170 operates first rest period 200 for up to twelve seconds. In another embodiment, method 170 operates first rest period 200 for approximately twelve seconds, such as between ten and fourteen seconds. In a further embodiment, method 170 operates first rest period 200 for at least twelve seconds.

After first rest period 200, method 170 initiates second initial spin 204. In one embodiment, method 170 operates second initial spin 204 for up to eight seconds. In another embodiment, method 170 operates second initial spin 204 for approximately eight seconds, such as between six and ten seconds. In a further embodiment, method 170 operates second initial spin 204 for at least eight seconds.

Method 170 stops second initial spin 204 for a second rest period 206 before initiating spin cycle 176. In one embodiment, method 170 operates second rest period 206 for up to twelve seconds. In another embodiment, method 170 operates second rest period 206 for approximately twelve seconds, such as between ten to fourteen seconds. In a further embodiment, method 170 operates second rest period 206 for at least twelve seconds.

In one embodiment, motor 120 is operated at a low speed during at least one of first and second spin cycles 190 and 192. The slow motor speed allows some of the soapy water to be slung into an annulus (not shown) of the washing machine 50. First and second rest periods 204 and 206 allow the suds to run down the side of tub 64 and allows pump assembly 72 time to remove the suds so that spin cycle 176 can finish at a high speed of the motor without generating suds that would slow the machine drive system down.

In one embodiment, method 170 slowly steps a variable speed motor module up to a terminal speed. For example, first initial spin is for 1.5 min at 130 rpm, second initial spin is for 1.5 min at 350 rpm and the speed that lasts until the spinning cycle has ended is a final speed of 630 rpm. In another embodiment, method utilizes a two speed motor such that both initial spins are at a first speed which is lower than a final speed for the spin that lasts to the spin cycle end.

In another embodiment, method 170 is implemented on a electronic control platform. In the electronic platform, method 170 utilizes software to start and stop the machine drive assembly as required. In another embodiment, method 170 is implemented on a electromechanical timer platform. On the electromechanical timer platform, a subinterval cam is utilized to make and break the motor contacts in the desired pattern. In a further embodiment, method 170 can be used in any two speed unit with either electronic or mechanical controls.

The herein described methods and apparatus offers technical effect of reducing the amount of suds created in a washing machine. The herein described methods and apparatus controls the time intervals for starting and stopping which are tuned to a motor's speed and ramp up torque. The herein described methods and apparatus can be utilized in any two-speed motor with either electronic or mechanical controls.

While the invention has been described in terms of various specific embodiments, those skilled in the art will recognize that the invention can be practiced with modification within the spirit and scope of the claims.

What is claimed is:

1. A method for extracting water from laundry articles between a wash cycle and a rinse cycle, said method comprising performing a spin cycle between the wash cycle and the rinse cycle, said spin cycle comprising:

a first initial spin extracting water from the laundry articles;

a first rest period after said first initial spin; and a spin subsequent said first rest period extracting additional water from the laundry articles, said spin subsequent said first rest period commencing immediately after said first rest period, said spin subsequent said first rest period comprising a spin lasting until a start of the rinse cycle.

2. A method according to claim 1 further comprising:

a second initial spin subsequent the first rest period, said second initial spin commencing immediately after said first rest period; and a second rest period subsequent the second initial spin, said spin subsequent said first rest period comprising a spin subsequent said second rest period and lasting until said end of said spin cycle.

3. A method according to claim 2 wherein at least one of said first initial spin and said second initial spin lasts for up to eight seconds.

4. A method according to claim 2 wherein at least one of said first initial spin and said second initial spin lasts for between six to ten seconds.

5. A method according to claim 2 wherein at least one of said first initial spin and said second initial spin lasts for at least eight seconds.

6. A method according to claim 2 wherein at least one of said first rest period and said second rest period lasts for up to twelve seconds.

7. A method according to claim 2 wherein at least one of said first rest period and said second rest period lasts for between ten to fourteen seconds.

8. A method according to claim 2 wherein at least one of said first rest period and said second rest period lasts for at least twelve seconds.

9. A method according to claim 1 wherein said first initial spin lasts for between 6–10 seconds and said first rest period lasts for between 10 and 14 seconds.

10. A washing machine comprising:

a basket;

a motor providing motion for said basket; and a controller operatively coupled to said motor for controlling said motor, said controller configured to perform a spin cycle between a wash cycle and a rinse cycle by starting said motor for a first initial spin, stopping said motor for a first rest period, and starting said motor immediately following the first rest period to spin until the spin cycle ends.

11. A washing machine according to claim 10 wherein said controller is further configured to start said motor for a second initial spin immediately following the first rest period, stop said motor for a second rest period subsequent the second initial spin, and start said motor subsequent the second rest period to spin until the spin cycle ends.

12. A washing machine according to claim 11 wherein at least one of the first initial spin and the second initial spin lasts for approximately eight seconds.

13. A washing machine according to claim 11 wherein at least one of the first rest period and the second rest period last for approximately twelve seconds.

14. A washing machine according to claim 11 wherein said controller comprises an electronic controller.

15. A washing machine according to claim 11 wherein said controller comprises an electromechanical controller.

16. A washing machine according to claim 11 wherein the first and second initial spins are at a first speed and the spin subsequent the second initial spin is at a second speed which is faster than the first speed.

17. A control system for a washing machine, the washing machine including a basket and a motor coupled to the basket to provide agitation in the basket, said control system configured to perform a spin cycle between a wash cycle and a rinse cycle by starting the motor for a first initial spin, stopping said motor for a first rest period, and starting the motor immediately following the first rest period to spin until the spin cycle ends.

18. A control system according to claim 17 further configured to start the motor for a second initial spin immediately following the first rest period, stop motor for a second rest period subsequent the second initial spin, and starting the motor subsequent the second rest period to spin until the spin cycle ends.

19. A control system according to claim 18 wherein at least one of the first initial spin and the second initial spin lasts for at least eight seconds.

20. A control system according to claim 18 wherein at least one of the first rest period and the second rest period last for at least twelve seconds.

* * * * *